US008011338B2

(12) United States Patent
Narayanakumar et al.

(10) Patent No.: US 8,011,338 B2
(45) Date of Patent: Sep. 6, 2011

(54) CAMCOVER OIL SEPARATOR

(75) Inventors: Ananth Narayanakumar, Canton, MI (US); Corey Weaver, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 384 days.

(21) Appl. No.: 12/208,713

(22) Filed: Sep. 11, 2008

(65) Prior Publication Data

US 2010/0059013 A1 Mar. 11, 2010

(51) Int. Cl.
*F01M 9/10* (2006.01)
*F02B 25/06* (2006.01)

(52) U.S. Cl. ..... 123/90.38; 123/195 C; 123/572

(58) Field of Classification Search ..... 123/90.38, 123/195 C, 196 R, 198 E, 524–526, 572–574
See application file for complete search history.

(56) References Cited

U.S. PATENT DOCUMENTS

| | | | | |
|---|---|---|---|---|
| 4,723,529 | A * | 2/1988 | Yokoi et al. | 123/573 |
| 5,005,553 | A * | 4/1991 | Washizu et al. | 123/572 |
| 6,378,483 | B1 | 4/2002 | Kato | |
| 7,117,858 | B2 | 10/2006 | Nonaka et al. | |
| 2007/0151215 | A1 | 7/2007 | Knittel et al. | |
| 2007/0215128 | A1 | 9/2007 | Yonebayashi et al. | |
| 2008/0047519 | A1 | 2/2008 | Naito et al. | |

FOREIGN PATENT DOCUMENTS

EP 1482136 12/2004

* cited by examiner

*Primary Examiner* — Noah Kamen
(74) *Attorney, Agent, or Firm* — Allan J. Lippa; Alleman Hall McCoy Russell & Tuttle LLP

(57) ABSTRACT

Systems are provided for separating oil from blow-by gases in an internal combustion engine. In one example, a system comprises a camcover configured to be mounted on a cylinder head, and a baffle positioned between the camcover and the cylinder head. The baffle may include at least a first and a second baffle plate, the first baffle plate including a first through-hole on a first face of the first baffle plate, the second baffle plate including a second through-hole on a second face of the second baffle plate. Further, the first and second faces may be positioned opposite one another, and offset such that the first and second through-holes are not fully overlapping.

19 Claims, 4 Drawing Sheets

CAMCOVER OIL SEPARATOR

FIELD

The present application relates to an oil separator provided in an internal combustion engine to separate oil from blow-by gases.

BACKGROUND AND SUMMARY

When an air-fuel mixture is combusted in an engine combustion chamber, a small portion of the combusted gas may enter the engine crankcase through the piston rings. This gas is referred to as blow-by gas. To prevent this untreated gas from being directly vented into the atmosphere, a crankcase ventilation system is provided between the higher pressure crankcase and the lower pressure intake manifold to allow the blow-by gas to flow from the crankcase into the intake manifold and be mixed with fresh air. From here, the gas may be re-inducted into the combustion chamber for re-combustion.

Engine lubrication oil used to lubricate moving parts of the engine is present in the crankcase during normal engine operation. The high pressure in the crankcase causes some of the lubricating oil to be suspended in a mist form. This oil mist can then mix with the blow-by gas and be returned to the intake manifold for combustion via a communication passage. However, combustion of the oil may cause the net oil consumption to increase, as well as degrade engine emission quality. To address these issues, oil separators have been developed to separate the oil content from the blow-by gas containing the oil mist. After separation, the oil is returned to the engine lubricating system while the blow-by gas is returned to the engine intake system.

One such oil separator is disclosed by Nonaka et al. in U.S. Pat. No. 7,117,858 wherein the separator is provided in combination with a cylinder head cover of an internal combustion engine. The separator includes a separator cover with a partition wall to define a first and second separator chamber on opposite sides of the wall, as well as a plurality of drain pipes to drain oil droplets from the separator into a valve operating chamber. In '858, the configuration of the separator causes the flow rate of the blow-by gas to be lowered in the separator chambers to thereby allow the oil to separate by its own weight. The cover further includes a plurality of projection walls projecting from the inner surface of the cover for separating oil from the mist by impaction.

However, the inventors have recognized several issues with such an oil separator. As one example, the distinct chambers and the related partition walls consume a significant amount of the limited space available above the cylinder head in the engine compartment. For example, in a turbocharged V-6 engine operating with a direct injection of gasoline, the configuration of the engine may result in very limited space, particularly above the cylinder heads on the left hand bank. The spatial constraints may not allow an oil separator with the configuration of '858 to be mounted. As such, this may lead to a reduction in oil separation efficiency in the engine, thereby degrading overall engine oil consumption and exhaust emission levels.

Thus in one example, the above issues may be addressed by an oil separator mounted on a cylinder head of an internal combustion engine, to separate oil mist from blow-by gas. The oil separator may comprise a camcover configured to be mounted on a cylinder head and a baffle positioned between the camcover and the cylinder head. The baffle may include at least a first and a second baffle plate, the first baffle plate including a first through-hole on a first face of the first baffle plate, the second baffle plate including a second through-hole on a second face of the second baffle plate. The first and second faces may be positioned opposite one another, and may be offset such that the first and second through-holes are not fully overlapping. The positioning of the first and second faces and the degree of overlap between the through-holes may be adjusted responsive to the particle size of the oil. In some embodiments, the through-holes may be offset such that they are partially overlapping. In other embodiments, the through-holes may be offset such that there may be substantially no overlap, thereby causing oil separation by multiple and repetitive impacts.

In this way, multiple impaction stationary baffles may be incorporated into an oil separator to meet the high oil challenge in an engine. In one particular example with similarly shaped baffles, manufacturing costs may be reduced. Manufacturing costs may also be reduced by further molding the whole baffle arrangement using a single plastic mold. And, in another example in which the separator is configured to enable oil separated at the baffles to drip directly onto the camshaft or onto cam caps, the need for oil drain valves and/or oil drain paths may be averted or reduced, thereby allowing the separator to work more efficiently within the spatial constraints.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
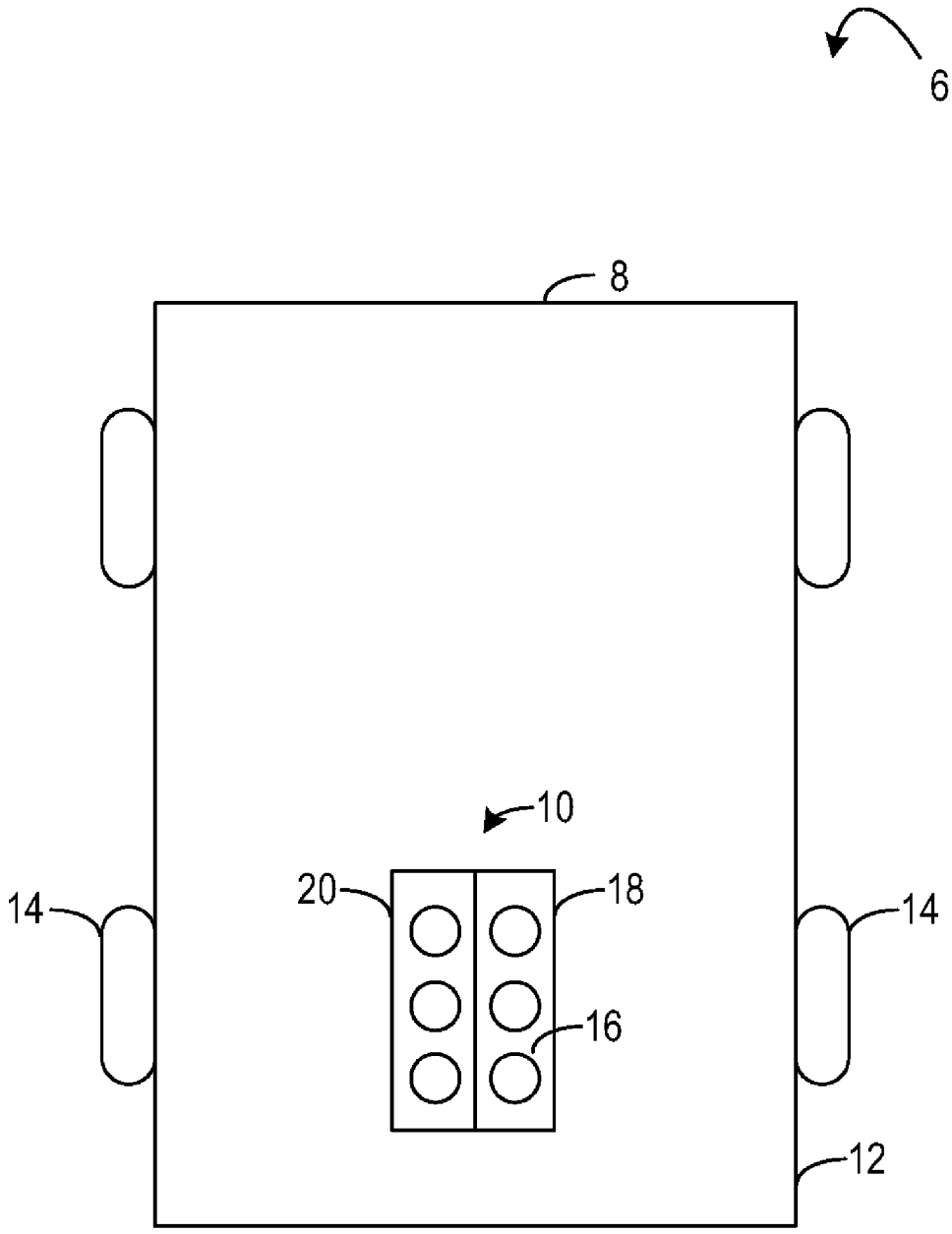
FIG. 1 shows an example engine layout within a vehicle system.
Figure 2:
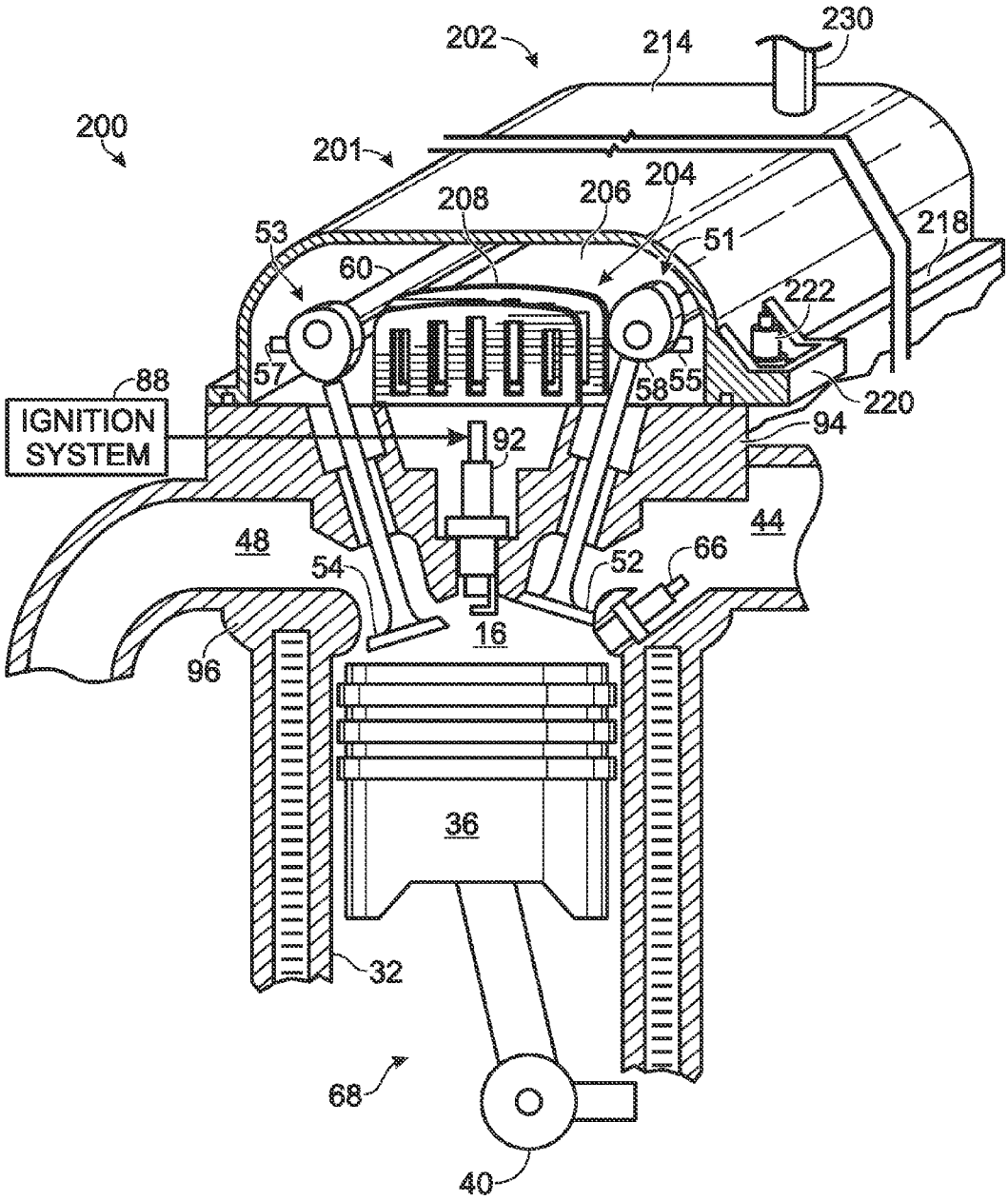
FIG. 2 is combination cross-sectional and isometric depiction of one cylinder in an internal combustion engine configured to propel a vehicle, with an oil separator configured in accordance with the present disclosure.
Figure 3:
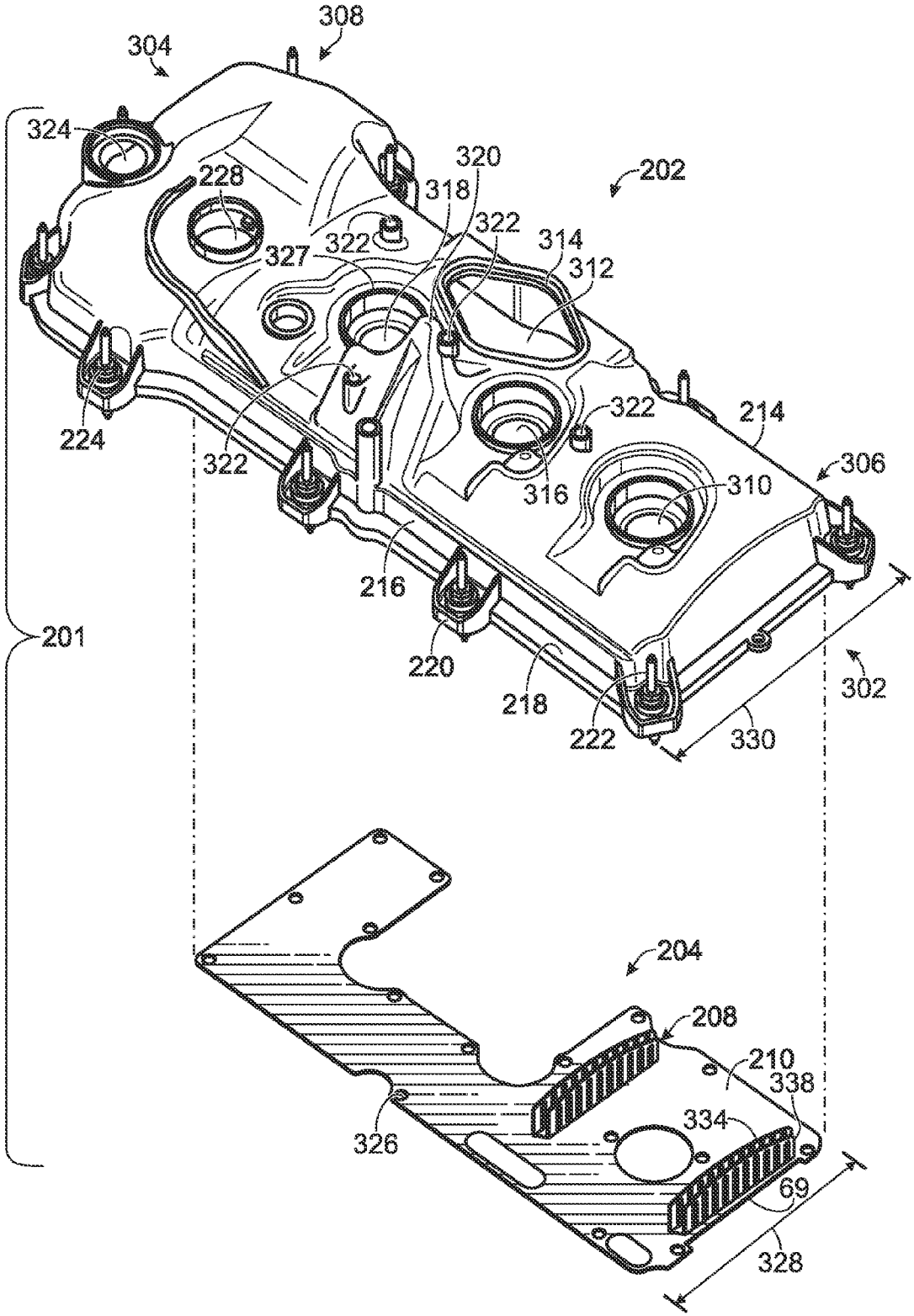
FIG. 3 is an exploded view of the components and configuration of the oil separator including an upper camcover and a lower baffle plate assembly.

The following description relates to a system for separating oil from blow-by gas in an engine of a vehicle as shown in FIG. 1. The oil separator of the present disclosure is mounted inside an internal combustion engine, on top of a cylinder head, to substantially envelop a camshaft assembly, as shown in FIG. 2. As shown in FIG. 3, the oil separator may include at least two components, viz. an upper camcover and a lower baffle plate assembly. The oil separator may further employ a plurality of projections, or baffles, as illustrated with reference to FIGS. 3-4, to create a tortuous path for the blow-by vapors that are trapped in an oil separation chamber created by the oil separator. While passing through the tortuous path, the oil is separated from the mist by multiple-impaction. The separated oil is returned to the camshaft assembly for lubricating the rotating cam lobes, camshaft and/or the valve assembly. The baffles may be tuned to different engines based on the desired oil challenge, oil particle size, and an oil consumption target. Use of similar shaped baffle plates reduces manufacturing costs. Thus, an oil separator of the disclosed configuration enables efficient oil separation notwithstanding engine spatial constraints.

FIG. 1 shows a vehicle system 6 including vehicle 8. Engine 10 is provided in an engine compartment of vehicle 8. In the depicted example, vehicle 8 is an automobile. In alternate examples, engine 10 may be included as a portion of a hybrid propulsion system including one or more other motors or engines, such as in the case of a hybrid electric vehicle (HEV). While the example applications of engine 10 will be described with reference to vehicle 6, it should be appreciated that engine 10 may be used in other applications not necessarily confined to vehicle propulsion systems.

Engine 10 is located towards the front 12 of vehicle 6, generally forward of the front wheels 14 and behind a radiator (not shown). Engine 10 may include a plurality of cylinders 16. As depicted, engine 10 is a 6-cylinder, V-shaped, four-stroke engine, although it will be appreciated that the engine may have a different cylinder configuration (for e.g., in-line, or opposed) and/or a different number of cylinders (e.g., four, or eight). The plurality of cylinders 16 may be aligned to clearly distinguish a left-hand side 18 of the engine from a right-hand side 20. The oil separator of the present disclosure may be mounted on a cylinder head of the engine block (as illustrated in FIG. 2), on the left-hand side 18. However, a similar (or symmetric) oil separator may also be used on the right-hand side 20 of the engine.

FIGS. 2-5 illustrate additional details of an oil separator located in engine 10 for separating oil from blow-by gas, before the gas is returned to the intake manifold of engine 10. First, the general layout of the oil separator with respect to the cylinders of engine 10 is described with reference to FIG. 2.

FIG. 2 shows a combination cross-sectional and isometric diagram 200 of one cylinder 16 of multi-cylinder engine 10. Engine 10 may be controlled at least partially by a control system that may include a controller (not shown), and by input from a vehicle operator via an input device such as an accelerator pedal. Combustion chamber (i.e. cylinder) 16 of engine 10 may include combustion chamber walls 32 with piston 36 positioned therein. Piston 36 may be coupled to crankshaft 40 so that reciprocating motion of the piston 36 is translated into rotational motion of the crankshaft 40. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 16 may receive intake air from an intake manifold 44, and may exhaust combustion gases via exhaust passage 48. Intake manifold 44 and exhaust passage 48 may selectively communicate with combustion chamber 16 via respective intake valve 52 and exhaust valve 54. In some embodiments, combustion chamber 16 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams 58 and may utilize one or more of cam profile switching (CPS), variable cam timing (VCT), variable valve timing (VVT) and/or variable valve lift (VVL) systems that may be operated by the controller to vary valve operation. The cams 58 may be configured to rotate on respective revolving camshafts 60. As depicted, the camshafts may be in a double overhead camshaft (DOHC) configuration, although alternate configurations may also be possible. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 16 may include an intake valve controlled via electric valve actuation and an exhaust valve controlled via cam actuation including CPS and/or VCT systems.

Fuel injector 66 is shown coupled directly to combustion chamber 16 for injecting fuel directly therein in proportion to a pulse width of a signal that may be received from the controller. In this manner, fuel injector 66 provides what is known as direct injection of fuel into combustion chamber 16. The fuel injector 66 may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 16 may alternatively or additionally include a fuel injector arranged in intake passage 44 in a configuration that provides what is known as port injection of fuel into the intake port upstream of combustion chamber 16.

Ignition system 88 may provide an ignition spark to combustion chamber 16 via spark plug 92 in response to a spark advance signal from the controller, under select operating modes. Though spark ignition components are shown, in some embodiments, combustion chamber 16 or one or more other combustion chambers of engine 10 may be operated in a compression ignition mode, with or without an ignition spark.

Cylinder head 94 may be coupled to a cylinder block 96. The cylinder head 94 may be configured to operatively house, and/or support, the intake valve(s) 52, the exhaust valve(s) 54, the associated valve actuation systems 51 and 53, and the like. Cylinder head 94 may also support camshafts 60. Other components, such as spark plug 92 may also be housed and/or supported by the cylinder head 94. The cylinder block 96 may be configured to house the piston 36. In one example, cylinder head 94 may correspond to a cylinder located at a first end of the engine.

While FIG. 2 shows only one cylinder 16 of a multi-cylinder engine, each cylinder may similarly include its own set of intake/exhaust valves, fuel injector, spark plug, etc.

FIG. 2 also shows an oil separator 201 mounted on and supported by cylinder head 94. The oil separator 201 may be substantially rectangular in shape, extending lengthwise along the length of the engine bank, that is, in a direction parallel to the axes of the camshafts 60.

Oil separator 201 may comprise of an upper camcover 202 and a lower baffle plate assembly 204. Upper camcover 202 may be mounted on cylinder head 94, substantially covering cylinder head 94, and fully enclosing the components of the lower baffle plate assembly 204 and the camshaft assembly. Lower baffle plate assembly 204 may be configured to directly sit on cylinder head 94. Together, the upper camcover 202 and lower baffle plate assembly 204 may define a space above the cylinder head wherein oil separation may occur, hereafter referred to as oil separation chamber 206.

Continuing now with reference to FIGS. 2 and 3, camcover 202 may include a main body 214 which may be generally dome shaped, and may be configured to substantially provide a covering surface. Camcover 202 may also include a peripheral section 216. The peripheral section 216 may extend into a perimeter flange 218 that is juxtaposed on cylinder head 94. The camcover 202 may be mounted and sealed on cylinder head with a plurality of bolts 222 threaded through a plurality of bolt insertion holes 220 interspersed along the perimeter flange 218 of camcover 202. To additionally seal oil separator 201 onto cylinder head 94, an elastomeric perimeter gasket (not shown) may be provided on the lower surface of the camcover 202. Specifically, the perimeter gasket may be located on the lower surface of the camcover, near the junction where the peripheral section 216 starts extending into the perimeter flange 218.

Blow-by gas from crankcase 68 may configured to enter oil separation chamber 206 upon passage through a positive crankcase ventilation (PCV) inlet 69. The PCV inlet 69 may be next to the baffles 208 of oil separator 201, towards narrow end 302. Internal passages (not shown) may be provided for the blow-by gas to flow from the crankcase via the cylinder head into the separation chamber 206. After the oil has been separated, air may exit the separator via PCV (Positive crank case Ventilation) opening 230. Flow of blow-by gas through the separation chamber 206 may be controlled in-part by a PCV valve (not shown), in particular during a boost-assisted engine operating mode. Alternatively, the flow may be controlled by coupling the passage to the air induction tube of the air induction system (not shown) which in turn is connected to an engine air compressor (not shown). In this way, the flow of blow by gases may be controlled indirectly by the compressor. In the separation chamber 206, suspended oil particles may be separated from the blow-by gas by multiple impaction of the particles with baffles 208 of baffle plate assembly 204.

Blow-by gas from crankcase 68 may be configured to enter oil separation chamber 206 upon passage through a positive crankcase ventilation (PCV) inlet 69. The PCV inlet 69 may be next to the baffles 208 of oil separator 201, towards narrow end 302. Internal passages (not shown) may be provided for the blow-by gas to flow from the crankcase via the cylinder head into the separation chamber 232. After the oil has been separated, air may exit the separator via PCV (Positive crank case Ventilation) opening 230. Flow of blow-by gas through the separation chamber 232 may be controlled in-part by a PCV valve (not shown), in particular during a boost-assisted engine operating mode. Alternatively, the flow may be controlled by coupling the passage to the air induction tube of the air induction system (not shown) which in turn is connected to an engine air compressor (not shown). In this way, the flow of blow by gases may be controlled indirectly by the compressor. In the separation chamber 232, suspended oil particles may be separated from the blow-by gas by multiple impaction of the particles with baffles 208 of baffle plate assembly 204.

Now, further details regarding the oil separator, including an exploded view of the constitutive components, are elaborated with reference to FIG. 3. While FIG. 3 (as well as FIGS. 4-5) are drawn approximately to scale, various modifications may be made, such as those noted herein.

The upper component of oil separator 201, that is camcover 202, may be generally rectangular in shape. As such, camcover 202 may be comprised of plastic and may be manufactured independent of the lower baffle plate assembly 204. While substantially rectangular, the camcover 202 may have a narrow end 302 and wide end 304. Accordingly, the camcover 202 may be divided into a narrow section 306 and a wide section 308. Specifically, the wide section 308 of the camcover may be located towards the wide end 304 while the narrow section 306 may be located towards the narrow end 302 of the camcover.

As previously elaborated, peripheral section 216 may extend into perimeter flange 218. Perimeter flange 218 may include a plurality of bolt insertion holes 220, interspersed along the perimeter of camcover 202, in to which bolts 222 (or studs) may be threaded for connection to cylinder head 94. Each insertion hole 220 may align with a corresponding hole in the top of cylinder head 94. A stud and grommet assembly 224 may be used in the holes to affix oil separator 201 to cylinder head 94. The main body 214 of camcover 202 may further include a plurality of holes. The plurality of holes may be dispersed between the narrow 306 and wide sections 308 of the camcover main body 214. As one example, a plurality of spark plug holes 327 may be formed in the narrow section 306. In the depicted example, the camcover has 3 spark plug holes, although in alternate embodiments, it may have a different number, such as 4 or 6. The spark plug holes 327 may be located at positions which respectively correspond to the center of underlying cylinder bores. The spark plug holes may be numbered based on the corresponding cylinder number. Alternatively, the spark plugs may be numbered based on their distance from the narrow end 302 of the camcover, as depicted. Thus, the spark plug hole closest to the narrow end may herein be labeled spark plug hole #1 310, and so on. Spark plugs may be fixedly disposed in the respective spark plug holes.

A rhombus-shaped large fuel pump hole 312 may also be provided in the narrow section 306, located directly above the fuel pump (not shown). A fuel pump gasket 314 may be disposed along the periphery of the fuel pump hole to provide a seal between a fuel pump mounting surface and a fuel pump spacer block or cylinder block. The fuel pump hole 312 may be configured substantially parallel to spark plug holes #2 and #3 316 and 318. Towards the middle of narrow section 306, the camcover main body 214 may include a protruded diverter 320. As such, this protruded diverter may be present to prevent fuel pump and/or fuel lines from getting damaged during a vehicle crash within the underlying space. The protruded diverter 320 may be located substantially opposite the fuel pump hole 312 and rising between spark plug holes #2 and #3. Additional holes 322 may be provided in the narrow section for holding a wire harness (not shown) in place.

The wide section 308 of camcover 202 may also be configured with a plurality of holes. In the depicted embodiment, the wide section 308 may comprise primarily two holes corresponding to an oil fill hole 228 and a VCT hole 324. The VCT hole 324 may be positioned above a bolt-affixed VCT solenoid (not shown). Electrical connections (such as a VCT coupling) to the VCT solenoid may be fixedly disposed in the VCT hole 324 and sealed with an appropriate sealing element, such as a VCT gasket (not shown). PCV pipe connection 230 may be configured to enable the blow by gas (after oil has been separated from it in the separator chamber) to be transferred into the engine intake manifold. In case of turbocharged engines, this PCV pipe connection 230 may connect to a compressor inlet tube of the turbocharger, which in turn transfers blowby gas and air to the intake manifold.

Now turning to the lower baffle plate assembly 204, the assembly includes a plurality of baffles 208 affixed to a base plate 210. The plurality of baffles may be positioned between the camcover and the cylinder head. The baffle plate assembly 204 may be secured to the camcover 202 with a joining element, such as a screw, rivet, stud, etc., threaded through the plurality of fastening holes 326 formed in the base plate 210. The plurality of baffles 208 may be affixed to the base plate 210 and may rise upwards from the base plate towards the camcover main body 214, in a direction perpendicular to the axes of the rotating camshafts. Base plate 210 may have a base plate width 328 equal to a width 330 of the camcover, not including the peripheral flange section. The baffles 208 may be placed below the camcover 202 such that the perimeter gasket of the upper camcover may substantially surround the perimeter of the baffle base plate 210.

Figure 4:
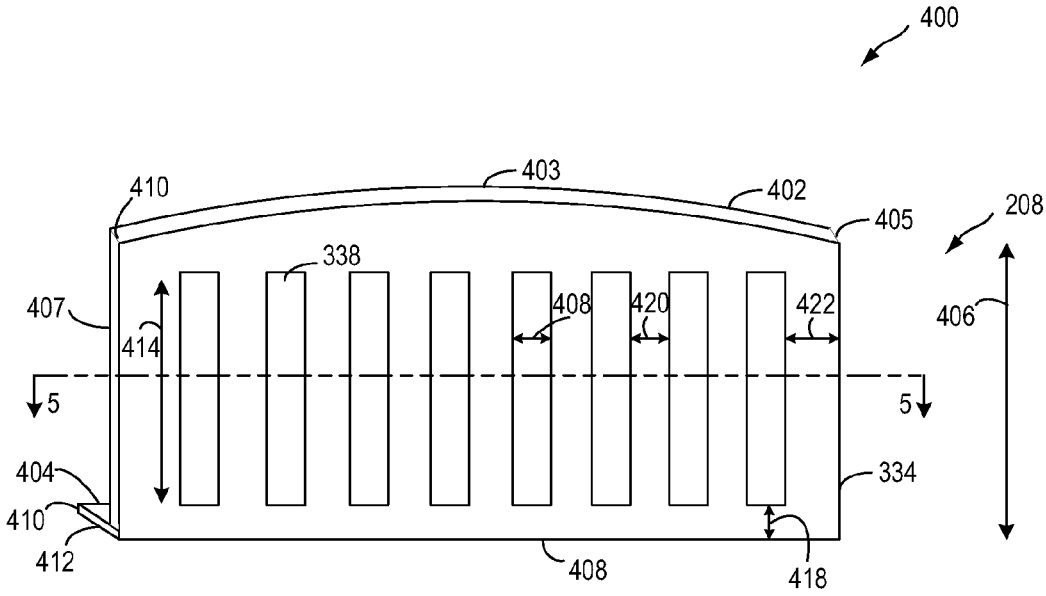
FIG. 4 is an exploded front view of a baffle of the baffle plate assembly

Each of the plurality of baffles 208 may include a plurality of baffle plates 334. The illustrated example depicts two baffles, wherein each baffle 208 includes a first and a second baffle plate 334. However, in alternate embodiments, a larger number of baffles may be present, and further, each baffle may comprise a larger number of baffle plates. Each baffle plate may have a face (FIG. 4). As further elaborated with reference to FIGS. 4 and 5, in one (depicted) embodiment, the baffle plates 334 may be arranged such that they may not align with each other, but instead, may be offset by an offset distance. The two baffles 208 may be positioned on the base plate 210 such that they may be disposed on either side of spark plug hole #1 310. In one example, the engine may be a gasoline-fueled turbo-charged two-bank engine and the oil separator may be mounted on a cylinder head of only one bank of the engine, such as the left hand bank, of the engine. Herein, the first and second baffle of the baffle plate assembly may be located on a first and second side, respectively, of a cylinder of that bank, such that the baffles may be parallel to each other with their faces facing each other. A detailed view and description of the baffles may be found below with reference to FIGS. 4-5. Each baffle plate 334 may include a plurality of through-holes 338 therein. The plurality of through-holes 338 may be regularly interspersed along the length of the baffle plate. The baffles may be aligned with the upper camcover 202 such that rotating camshafts 60 may sit on, or right above, the baffles 208.

Camcover 202 and baffle plate assembly 204 may both comprise plastic materials to reduce manufacturing costs. However, in alternate embodiments, the entire baffle plate assembly, or parts thereof, may be fabricated of metal. As one example, camcover 202 and baffles 208 may be molded of plastic, while base plate 210 may be manufactured out of metal. The plurality of baffles 208, including baffle plates 334, may be similarly shaped (that is, of identical shape and size) enabling a single tool to be used to manufacture them. This may also help in reducing manufacturing costs. In some embodiments, the baffle plate assembly 204 may be combined with camcover assemblies of varying design, such as pre-existing camcover designs, to thereby enable efficient oil separation without requiring a change in camcover casting.

Blow-by gas entering the oil separation chamber 206 through the PCV hole 228 may be forced through the baffles 208 via the shape of assembly. Since the baffles are located at the narrow end 302 of camcover 202, that is, at the opposite end from the PCV hole 228 (which is in the wide section 308), a relatively long passage for the blow-by gas is created. The baffles 208 create a tortuous path for the blow-by vapors, thereby separating a majority of the suspended oil droplets from the blow-by gas before the gas is returned to the intake system. Oil mist is separated by passage of the blow-by gas via through-holes 338 in baffle plates 334 and upon multiple impaction of the suspended oil droplets against the baffle plates. Oil droplets may strike and adhere to the baffles 208 and gradually grow into larger oil droplets that may drop to the base plate 210 due to their own weight. The separated oil droplets may then collect in the oil separation chamber 206 where they may be used again to lubricate the rotating cams and camshafts.

FIG. 4 shows an exploded view 400 of part of a single baffle 208 of the baffle plate assembly. Specifically, FIG. 4 depicts a single baffle plate 334 of the baffle 208. However, it will be appreciated that a similarly shaped baffle plate may be positioned behind the depicted one. Baffle plate 334 may be generally rectangular shaped with the long axis running perpendicular to the long axis of the rectangular base plate. The upper edge 402 of the baffle plate may be slightly curved. Each baffle plate may be joined to the baffle base plate via a supporting flange 404. In one embodiment, the baffle plate may be fixed to the base plate at the flange 404 by a weld. In another embodiment, the baffle plate may be fixed to the base plate at the flange 404 by fastening elements running through a plurality of holes (not shown) on the flange 404 for threaded engagement to the base plate 210. As such, the supporting flange may be an extension of the baffle plate 334. Alternatively, the pair of baffle plates may be manufactured from a single sheet (of metal, or plastic) and bent to allow an intermediate common flange to be created between the plates. The plurality of baffle plates may include a first baffle plate with a (first) face 407 and second baffle plate with a similar (second) face 407. As such, the face 407 of baffle plate may represent a face directed towards the supporting flange. Further, the first and second baffle plates 334 in the depicted baffle 208 (as shown in FIG. 3) may be arranged with their faces positioned opposite one another. In alternate embodiments, the baffle plates may be arranged with their faces 407 looking in the same direction.

Baffle plate 334 may have a length 406, a breadth 408, and a thickness 410. While the baffle plate is substantially rectangular, due to the presence of a slight curvature at the upper surface, the length of the baffle plate at a middle section 403 may be greater than the length at the edges. Further, the length may gradually taper down from its maximum value at middle section 403 to the edges 405. Supporting flange 404 may have the same breadth and thickness as baffle plate 334, but may have a differing length 412. As such, the length of the supporting flange may be substantially smaller than that of the baffle plate 334.

The first and second baffle plates may include at least a first and a second through-hole on their respective faces. For example, the baffle plates may each include a plurality of through-holes. While in the depicted example, each baffle plate has an equal number of through-holes, in alternate example, each baffle plate may have a different number of through-holes. The plurality of through-holes 338 in the baffle plate may be substantially rectangular in shape with the long axis of the rectangle substantially parallel to the length of the baffle plate. However, in alternate embodiments, the through-holes may be substantially rectangular with at least a partially curved perimeter. Alternatively, the through-holes may be oval, circular, or any other appropriate shape. Each rectangular through-hole 338 may have a length 414 and breadth 416. Each through-hole may be positioned at a distance 418 from the junction of the baffle plate with the base plate. The through-holes at either end of the baffle plate may be positioned at a distance 422 from the edge of the baffle plate. The plurality of through-holes 338 may be arranged in a parallel configuration and may be separated from each other at regular intervals of distance 420. In the depicted embodiment, the length of each through-hole may also vary, based on the location of the through-hole in the baffle plate 334, to mirror the varying length of the baffle plate 334. Thus a first through-hole may have a first length that is different from a neighboring second through-hole (or a corresponding through-hole of an opposite baffle plate) with a second length. Similarly, the through-holes may also differ in their breadth. However, in still other embodiments, the through-holes may all have an identical length and breadth.

The baffles 208 can be manufactured with a high degree of flexibility in the design of the baffle plates 334 and through-holes 338. Further, the baffle plates 334 may be arranged vis-à-vis each other with a high degree of flexibility. Thus, the baffle plates may be designed with varying height, varying width, varying through-hole dimension, varying through-hole interval, etc. The baffle design may be varied responsive to an oil challenge, an oil particle size, and/or a target oil consumption rate.

Figure 5:
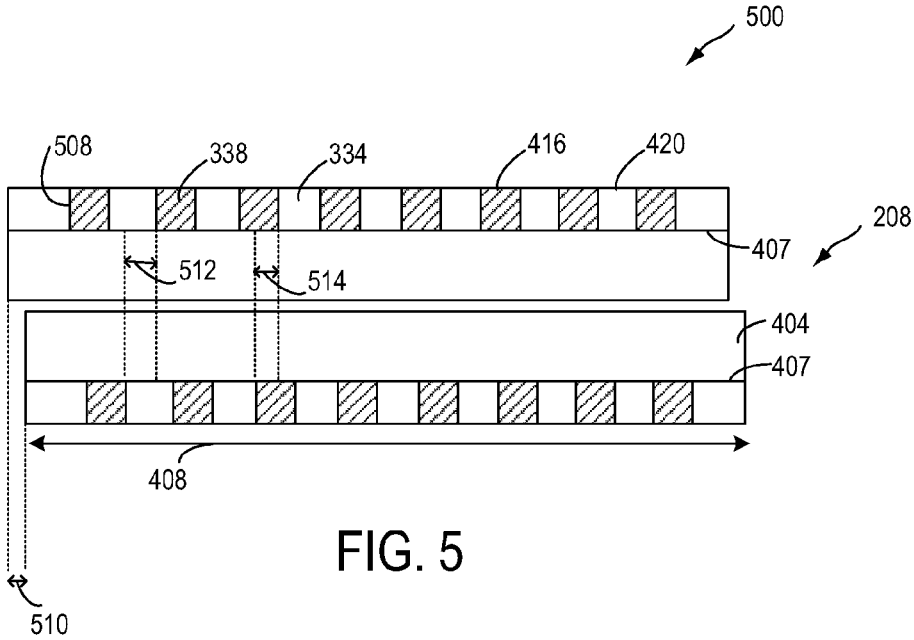
FIG. 5 is a top view of a cross section of the baffle of FIG. 4, cut along the line 5-5.

Further details regarding the arrangement of through-holes 338 in each baffle plate, and with regards to a pair of baffle plates in each baffle, is provided below with reference to FIG. 5. FIG. 5 depicts a top view 500 of a cross section of the baffle of FIG. 4, cut along the line 5-5. The two baffle plates 334 constituting baffle 208 are seen herein. The plurality of through-holes 338 are depicted as shaded boxes while the remaining solid part of the baffle plate is depicted as a solid box. A top view of the supporting flange 404 of the baffle is also shown.

As depicted, through-holes 338 may have a width 508. As such, the width of the through-hole may be the same as that of the baffle plate 334 while the length may be less than that of the baffle plate. Next, the through-holes may be separated by interval 420. The pair of baffle plates 334 may be positioned with their faces 407 opposite one another such that they are offset from each other by an offset distance 510. By arranging the faces of the baffle plates opposite one another, the corresponding through-holes on each baffle plate may also be offset such that the through-holes are only partially overlapping. Thus, as a result of the baffle plates being offset from each other, a gap 512 may be generated between corresponding through-holes in the two baffle plates, and further, the corresponding through-holes may overlap by overlap distance 514.

In engine designs with larger oil particle sizes, the breadth 416 of the through-holes may be increased. Additionally, or optionally, the interval 420 between the through-holes may be decreased, the number of through-holes may be varied (for e.g., increased or decreased) and/or the breadth 408 of the baffle plate may be varied. Alternatively, instead of adjusting the through-hole dimensions, the baffle plates may be offset by a smaller amount to allow a larger gap 512 and a larger overlap distance 514 is formed. Similarly, as an oil challenge increases, that is, as more oil is required to be separated efficiently, the breadth 408 of the through-holes may be decreased. Additionally, or optionally, the interval 508 between the through-holes may be increased, and the number of through-holes and/or breadth of the baffle plate may be varied (for e.g., increased or decreased). Alternatively, the baffle plates may be offset by a larger amount to allow a smaller gap 512 or a smaller overlap distance 514 to be formed. It will be appreciated that the various adjustments may be made in isolation or in tandem, based on the resultant effect on oil separation. Further still, in some embodiments, the baffle plates may not be offset at all, and instead may be aligned with each other.

By adjusting the dimensions of the through-holes, their offsetting distance and the resultant gap between them, the frequency with which a suspended oil droplet may impact the baffle plate may be varied. The same adjustments may also affect the size and tortuousness of the passage through which the blow-by gas is forced to flow.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system with an internal combustion engine comprising:

a camcover configured to be mounted on a cylinder head;

a first overhead cam driven by a first camshaft;

a second overhead cam driven by a second camshaft; and a baffle positioned between the camcover and the cylinder head, the baffle including at least a first and a second baffle plate, the first baffle plate including a first through-hole on a first face of the first baffle plate, the second baffle plate including a second through-hole on a second face of the second baffle plate, the first and second faces positioned opposite one another, and offset in a substantially horizontal direction extending laterally between and perpendicular to the first and second camshafts such that the first and second through-holes are not fully overlapping.

2. The system of claim 1 wherein the baffle plates are fixed to a base plate by a fastening element or by a weld.

3. The system of claim 1 wherein the first and second baffle plates are each configured with a plurality of through-holes.

4. The system of claim 3 wherein the plurality of through-holes of at least one of the baffle plates are substantially rectangular in shape.

5. The system of claim 3 wherein the plurality of through-holes of at least one of the baffle plates are substantially rectangular in shape with at least a partially curved perimeter.

6. The system of claim 3 wherein the camcover and the baffle plates comprise plastic.

7. The system of claim 3 wherein the first and second baffle plates are similarly shaped.

8. The system of claim 1 wherein the first through-hole has a first length, and the second through-hole has a second length, the first length being different than the second length.

9. The system of claim 1 wherein the first through-hole has a first breadth, and the second through-hole has a second breadth, the first breadth being different than the second breadth.

10. The system of claim 1 wherein the first and second through-holes are partially overlapping.

11. A system with an internal combustion engine comprising:

a camcover configured to be mounted on a cylinder head substantially above at least a cylinder located at a first end of the engine; and a lower baffle plate assembly including a plurality of baffles affixed to a baseplate, the plurality of baffles positioned between the camcover and the cylinder head and substantially above the cylinder located at the first end of the engine, each of the plurality of baffles including at least a first and a second baffle plate, the first baffle plate including a plurality of substantially rectangular through-holes on a first face of the first baffle plate, the plurality of through-holes on the first face of the first baffle plate including a first substantially rectangular through-hole on the first face of the first baffle plate, the second baffle plate including a plurality of substantially rectangular through-holes on a second face of the second baffle plate, the plurality of through-holes on the second face of the second baffle plate including a second substantially rectangular through-hole on the second face of the second baffle plate, the first and second faces positioned opposite one another, and offset such that the first and second substantially rectangular through-holes are not fully overlapping.

12. The system of claim 11 wherein the plurality of rectangular through-holes on both the first face of the first baffle plate and the second face of the second baffle plate includes at least a first and a second through-hole, the first through-hole having a first length, the second through-hole having a second length, the second length being larger than the first length.

13. A system with a gasoline-fueled turbo-charged two-bank direct injected engine comprising:

an upper camcover configured to be mounted on a cylinder head of only one bank of the engine; and a lower baffle plate assembly including a plurality of baffles affixed to a base plate, the plurality of baffles positioned between the camcover and the cylinder head, each of the plurality of baffles including at least a first and a second baffle plate, the first baffle plate including a first through-hole on a first face of the first baffle plate, the second baffle plate including a second through-hole on a second face of the second baffle plate, the first and second faces positioned opposite one another, and offset such that the first and second through-holes are not fully overlapping.

14. The system of claim 13 wherein the only one bank is a left hand bank of the engine.

15. The system of claim 14 wherein the plurality of baffles includes a first and a second baffle, the first baffle located on a first side of a cylinder on the bank, and the second baffle located on a second side of the cylinder on the bank.

16. The system of claim 15 wherein the first baffle and the second baffle are in a parallel configuration.

17. The system of claim 16 wherein the first and second baffles are similarly shaped.

18. The system of claim 17 wherein the first and second through-holes are substantially rectangular in shape.

19. The system of claim 13 wherein the first and second through-holes are partially overlapping.

* * * * *